US005267604A

United States Patent [19]

Kuttner et al.

[11] Patent Number: 5,267,604

[45] Date of Patent: Dec. 7, 1993

[54] MOTION CONTROL SYSTEM FOR HORIZONTAL CONTINUOUS CASTER

[75] Inventors: Ralph Kuttner, Fullerton, Calif.; Timothy J. McGrath, Atlanta, Ga.

[73] Assignee: Steel Casting Engineering, Ltd., Hollsopple, Pa.

[21] Appl. No.: 607,694

[22] Filed: Nov. 1, 1990

Related U.S. Application Data

[63] Continuation-in-part of Ser. No. 431,290, Nov. 3, 1989, abandoned.

[51] Int. Cl.[5] ..... B22D 11/16

[52] U.S. Cl. ..... 164/413; 164/420; 164/440; 164/454

[58] Field of Search ..... 164/420, 440, 490, 413, 164/414, 452, 454, 455

[56] References Cited

U.S. PATENT DOCUMENTS

| | | | |
|---|---|---|---|
| 3,358,743 | 12/1967 | Adams | 164/420 |
| 3,563,297 | 2/1971 | Wertli | 164/413 |
| 3,614,978 | 10/1971 | Kosco | 164/413 |
| 3,669,176 | 6/1972 | Krall | 164/440 |
| 3,693,701 | 9/1972 | Waclawiczek | 164/440 |
| 4,195,685 | 4/1980 | Sladkoshteev | 164/440 |
| 4,469,993 | 9/1984 | Swanson | 318/603 |

*Primary Examiner*—Richard K. Seidel
*Assistant Examiner*—Rex E. Pelto
*Attorney, Agent, or Firm*—Breiner & Breiner

[57] ABSTRACT

A control system in combination with a horizontal continuous caster includes a casting system drive motor having a control loop operative thereon which also includes a start of stroke board. A cam selection system provides for application of individual cam profiles to the control loop of the motor. A display system provides display of the individual applied cam profiles and actual casting motion. Additional monitoring systems provide direct control of multiple system functions during the casting process. The control system based on velocity versus time is simplified in construction and provides rapid and precise control.

4 Claims, 4 Drawing Sheets

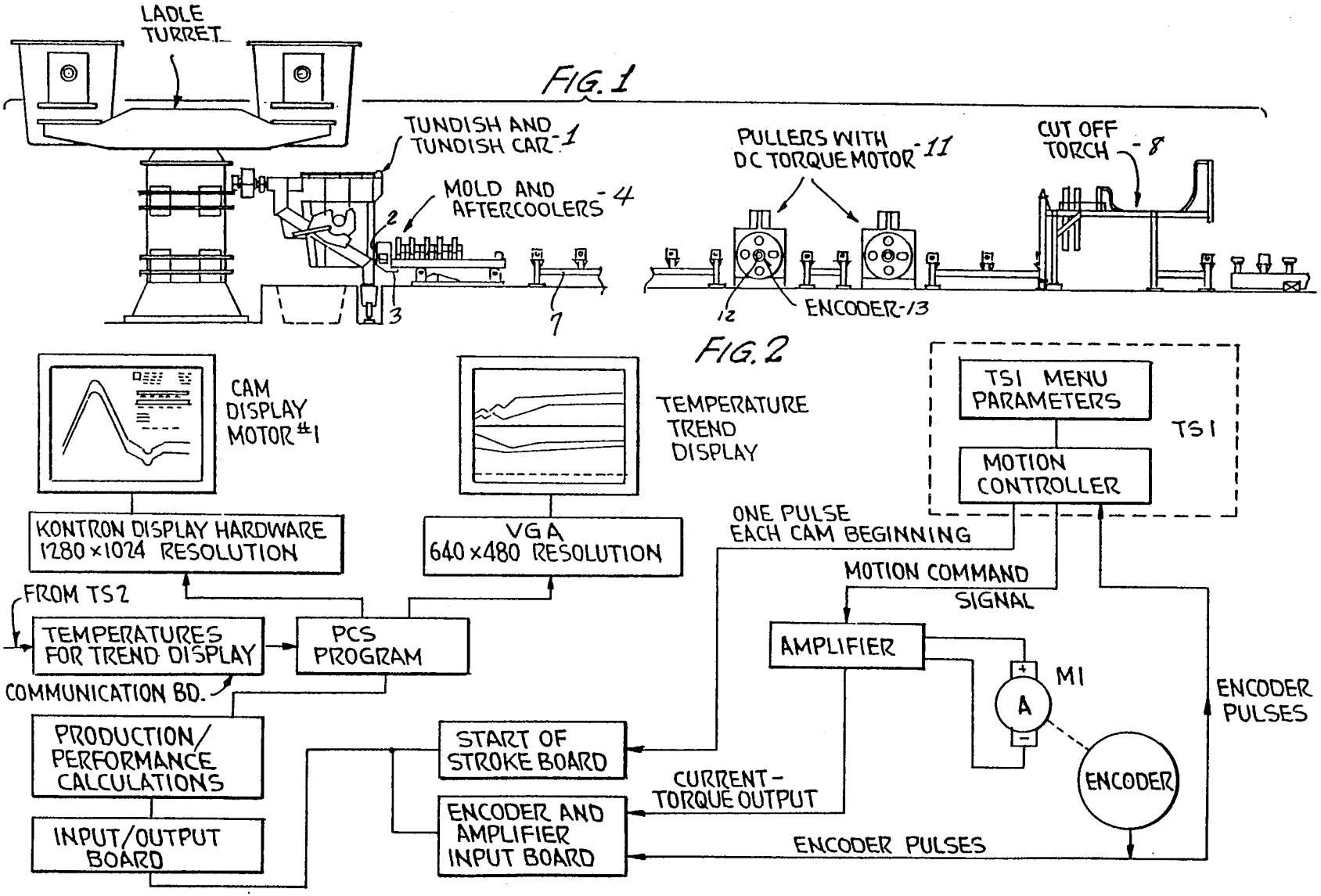
FIG. 1
LADLE TURRET
TUNDISH AND TUNDISH CAR-1
MOLD AND AFTERCOOLERS-4
PULLERS WITH DC TORQUE MOTOR-11
ENCODER-13
CUT OFF TORCH-8
FIG. 2
TEMPERATURE TREND DISPLAY
CAM DISPLAY MOTOR #1
VGA 640×480 RESOLUTION
KONTRON DISPLAY HARDWARE 1280×1024 RESOLUTION
TS1
TS1 MENU PARAMETERS
MOTION CONTROLLER
ONE PULSE EACH CAM BEGINNING
MOTION COMMAND SIGNAL
AMPLIFIER
M1
ENCODER
ENCODER PULSES
CURRENT-TORQUE OUTPUT
START OF STROKE BOARD
ENCODER AND AMPLIFIER INPUT BOARD
PCS PROGRAM
FROM TS2
TEMPERATURES FOR TREND DISPLAY
COMMUNICATION BD.
PRODUCTION/PERFORMANCE CALCULATIONS
INPUT/OUTPUT BOARD

MOTION CONTROL SYSTEM FOR HORIZONTAL CONTINUOUS CASTER

RELATED CASES

This application is a continuation-in-part of application Ser. No. 07/431,290 filed Nov. 3, 1989 now abandoned.

FIELD OF THE INVENTION

This invention relates generally to horizontal continuous casting systems and particularly to a motion control system for a single strand or multiple strand casting system.

BACKGROUND OF THE INVENTION

The development of horizontal continuous casting systems has permitted the casting of extended length constant cross-section castings, such as steel castings, in an economical and convenient manner. While the structures of horizontal continuous casting systems vary from manufacturer to manufacturer, the operative details are generally similar. These caster systems are described in U.S. Pat. Nos. 4,437,509; 4,520,860; 4,532,977; 4,580,614, and 4,774,996, the disclosures thereof incorporated herein by reference.

In the operation of a continuous caster, a supply of molten metal is provided to a tundish prior to the initiation of the casting process. Thereafter, a starter bar having a cross-section corresponding generally to that of the to-be-formed casting is inserted into the casting mold. Next, a slide gate on the tundish is opened and the molten metal within the tundish flows out through the exit port into the casting mold and welds to the starter bar. The drive motors then initiate the desired casting motion for the casting system and the process begins.

The motion of the casting which is forming within the casting mold comprises a series of motions in accordance with a predetermined motion profile. The motion profile most commonly used includes a series of short forward motions referred to as casting strokes. In a preferred system each forward motion is followed by a short reverse motion. Thus, in the preferred motion profile for a horizontal continuous casting operation, a series of motion cycles occur, each of which includes a forward casting stroke followed by a brief reverse movement.

Once the casting system has begun its steady state operation, the various parameters of the casting process must be carefully controlled to provide optimum castings. It is important that these various parameters are rapidly and precisely interrelated and controlled to provide quality castings. In order to obtain precise control of the motion of the casting, it has been proposed to utilize a computerized continuous casting system. Thus, Kosco, U.S. Pat. No. 3,614,978 discloses a computerized continuous casting system control responsive to strand position. In the system of the Kosco patent, the motor driving the casting is always going forward and, additionally, the system is based on positional control. As a result, the system cannot be utilized with a casting system having a series of forward and reverse motions. Further, as a result of the positional control features, the system is relatively slow and complex when the motion control is tied into the operating parameters such as furnace temperature, coolant flow, coolant temperature, and the like of the caster.

Accordingly, there is a need for a motion control system for utilization with horizontal continuous casters which is simplified, rapid, and which permits precise motion control even when tied into the operating parameters of the caster.

SUMMARY OF THE INVENTION

It is a general object of the present invention to provide an improved motion control system for a horizontal continuous casting system. It is a more particular object of the present invention to provide an improved motion control system for horizontal continuous casting which is particularly advantageous in controlling single or multiple strand horizontal continuous casting systems in a precise manner.

In accordance with the present invention, there is provided, in combination, a motion control system and a single or multiple strand horizontal continuous caster having furnace means; molds and aftercoolers; and drive means driven by an electric motor, preferably a DC torque motor. The motion control system comprises a closed loop control system operative upon an electric motor for each strand of the caster. Thus, an encoder is coupled to the output shaft of the electric drive motor. A sensor coupled to the encoder provides an output signal indicative of the rotational motion of the drive motor. A computer control system receives information and produces a series of signals corresponding to the desired motion profile or motion cycle to be used in the casting process. A detector system within the control loop responds to the encoder output and to a sample of the desired motion profile cam, and produces the appropriate output signal to be applied to the drive motor to achieve the desired motion. The output signal is amplified by a motor drive amplifier to a power level sufficient to operate the system's drive motor. The computer system receives information and updates the process control displays in real time on a velocity versus time profile of the drive motor. The system, based primarily on hardware, not software, gives real-time control and is extremely rapid and accurate.

BRIEF DESCRIPTION OF THE DRAWINGS

The invention, together with further objects and advantages thereof, may best be understood by reference to the following description taken in conjunction with the accompanying drawing. In the drawing, like reference numerals identify like elements and in which—

FIG. 1 illustrates the general arrangement of a horizontal continuous billet caster;

FIG. 2 is a block diagram of the motion control system based on velocity/time for use with the billet caster of FIG. 1;

DETAILED DESCRIPTION OF INVENTION AND PREFERRED EMBODIMENT

Figure 3:
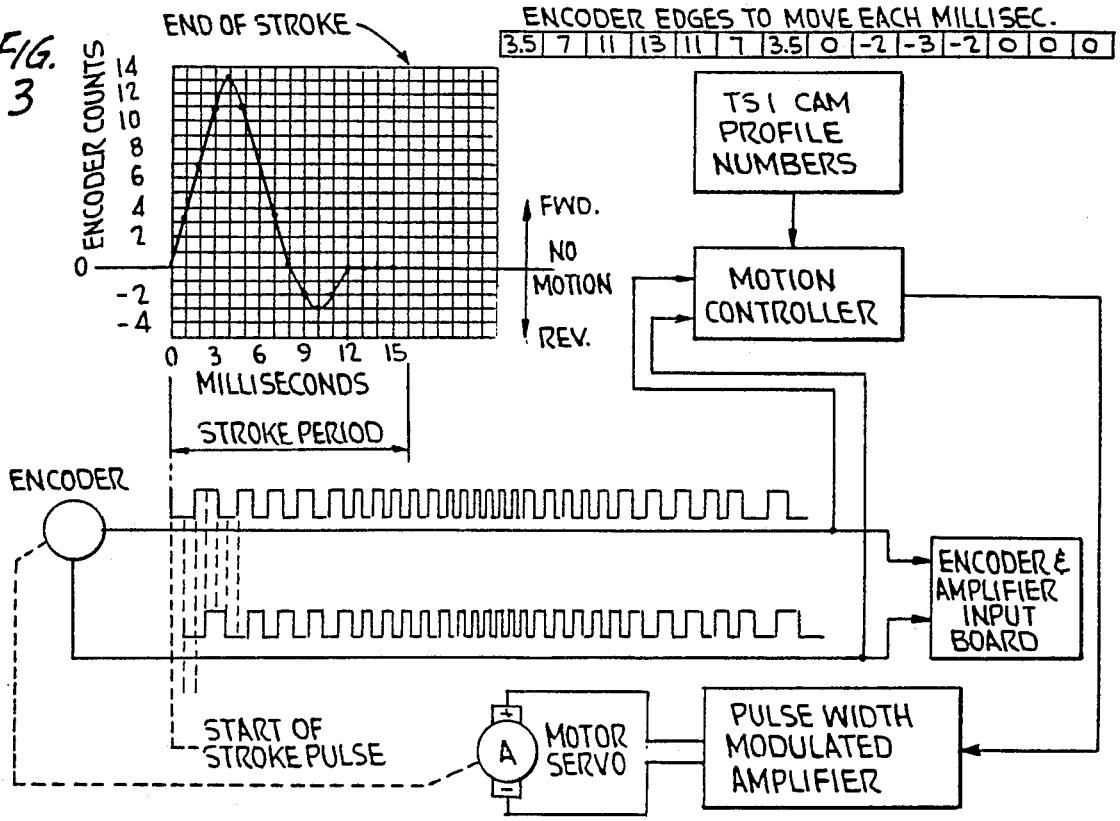
FIG. 3 is a detailed view of velocity/time stroke of the motion control system of FIG. 2.

Referring to FIG. 1 of the drawing, a tundish and tundish car 1 having an interior insulated reservoir is provided having an exit port 2 usually near the bottom surface of the tundish. A slide gate 3 is supported in proximity to the exit or discharge port of the tundish to permit the tundish to be opened or closed as needed. A refractory material, not shown, lines the interior of the tundish and protects the tundish structure against the molten metal supported therein. One or more ceramic elements or nozzles, not shown, are provided within the tundish discharge orifice to provide an appropriate interface to the remainder of the casting system. An elongated mold and aftercoolers 4, having a center passage therethrough configured to have a cross-section corresponding to that desired in the to-be-formed casting, are supported in a coupling arrangement to the slide gate 3 and nozzle against the tundish. The mold and aftercoolers includes a surrounding cooling system which provides for a substantial flow of coolant such as water about the exterior surfaces of the mold passage. The mold is generally formed of copper or other metal having a high thermal conductivity. A fluid control system is operative upon the casting mold to provide the necessary coolant flow in and about the exterior of the mold casting passage. At the discharge or exit portion of the casting mold, a series of support rollers 7 are arranged in a generally linear path to support and provide a rolling surface for the casting as it exits from the casting mold. One or more pullers with a DC torque motor 11 are operatively coupled to the emerging casting and provide the desired motion of the casting. A cut-off torch 8 is located downstream of the pullers which functions to cut the strands into proper lengths. As shown in FIG. 1, an encoder 13 is connected to the shaft 12 of torque motor 11. This encoder is the beginning of the motion control system.

The primary duty of the motion control system is to precisely control the DC motor pullers in order to provide precise extraction and solidification of steel during casting and to monitor and control all the hydraulic, pneumatic, and temperatures critical to proper casting conditions. A preferred form of the motion control system of the present invention, as best shown in FIGS. 2, 3, 4 and 5, is generally comprised of three AT type computers with an Intel 80386 architecture. In each of the AT computers are several "stand alone" single board computers dedicated to specific tasks. Each of the single board computers provides its own bus and external connections to the external components which interface to a controller card. The three AT type computers are named according to their primary function—

1. PCS—Process Control Screens
2. TS1—Touchscreen Interface #1
3. TS2—Touchscreen Interface #2

THE PCS—PROCESS CONTROL SCREENS

The PCS computer preferably contains ultra-fast, high resolution (1280×1024) display controllers which receive information from the AT bus and update the process control displays in real time. These displays are nearly as fast as a real time oscilloscope and display velocity versus time profiles of each motor which is casting steel, i.e., one motor for each strand. This display is essential for monitoring the proper extraction and solidification of the steel during casting. Additionally, the display can be designed, as desired, to show—

1. Production rates
2. Commanded curve versus actual curve
3. Following error
4. Actual motor torque curve
5. Motor torque average bar graph
6. Following error bar graph
7. Actual pullout length
8. Actual pushback length The PCS computer receives its information from an interface board which latches all of the encoder edges in both directions which is attached to the motor shaft of the drive motor for the strand being cast. The motor amplifier also provides a DC output proportional to the motor current. This is input to the interface board, and then converted to an actual motor torque display. The system utilizes Start-up Cams. Thus, there can be as many as eight alloy banks of eight each which provide pre-programmed extraction and pause profiles used when first starting the cast. A unique feature of the system is the use of single board computers which provide dedicated control systems for very fast real-time control of a specific task. The cam generation and touchscreen interface provide instantaneous regeneration of cam profiles during casting. The digital process displays provide oscilloscope-type waveforms of velocity profiles as well as color text and bar graph information not available from an oscilloscope. The PLC and data acquisition computers provide all required elements for a complete system integral within the control system so that no additional equipment is required at plant installation.

A separate monitor displays line trends of thermocouple and temperatures of casting molds, water temperatures of the coolers, and material handling equipment. This information is received through a communications link with the other two AT type computers, TS1 and TS2.

THE TS2—TOUCHSCREEN INTERFACE #2

The TS2 has one VGA (640×480 resolution) color display which has touchscreen capabilities so that when the graphic system display is touched, it provides control of all external system components such as pumps, solenoids, argon pressure in furnace, air pressures, water flow rates, furnace temperatures, utilities for specifying the type of equipment attached to the system, as well as the diameter of steel being produced, the specific density of the steel, and self-diagnostic routines in order to troubleshoot maintenance problems.

This computer also has single board computers for programmable logic controllers and data acquisition controllers which act as stand-alone computers on a card and receive information through a dual port RAM in order to interface to the host AT. A printer is also attached to TS2 for run-time logging of all events and data during casting. All thermocouples, flow rates, and events such as solenoids, pumps, and casting motor information are stored as well as communicated to the other two computers in the system.

THE TS1—TOUCHSCREEN INTERFACE #1

The TS1 is an important computer in the casting operation. It contains a stand-alone proportional-integral-differential (PID) loop motion control computer for each casting motor. The single board computers receive through a dual port ram interface the desired velocity profile for a casting motor, and at 1 millisecond update rates precisely control the extraction and push-back for each casting stroke. The operator interface is also a touchscreen which provides instantaneous generation and performance of cams which can be customized according to the specific alloy to be cast. These cams are stored in three different banks according to their function, i.e., a Custom Cam which is a single cam which allows an operator to instantaneously change any of several parameters which define a cam in order to optimize the casting profile for an alloy in experimentation; a Quick Select Cam which is eight alloy banks of eight cams in each bank which allow the operator to quickly go from any of the eight different pre-generated cams.

The entire control system is generally shown in FIG. 2. The encoder 13 sends pulses simultaneously to a motion controller and to an encoder and amplifier input board. The motion controller, in turn, sends a motion command signal to amplifier which is operatively connected to puller motor. The amplified command signal sends a current torque output reading to the encoder and amplifier input board. The motion controller also sends a signal to the start-of-stroke board. The boards simultaneously feed to an input/output board which, in turn, provides production performance calculations which are fed to PCS programmer. The PCS programmer receives temperatures for trend display from the TS2 computer, best shown in FIG. 5. The PCS program sends signals through the VGA color display and to a cam display for the puller motor. The TS1 computer menu parameters are also fed to the motion controller.

FIG. 3 displays in graphic form a stroke cycle of the puller motor. Thus, at the start of the stroke the motion is in a forward direction, followed by a short reverse motion, and then a pause before beginning the next cycle. As shown in FIG. 3, a stroke period is fifteen milliseconds. During the fifteen milliseconds, the strand being cast is moved forward for a period of nine seconds, and is moved in reverse for three seconds, followed by a three-second pause before beginning the next stroke. The system simultaneously checks and adjusts at least four functions, i.e., proportional, integral, differential, and feed forward. As a result, the actual performance of the system is extremely close to the predetermine profile.

Figure 4:
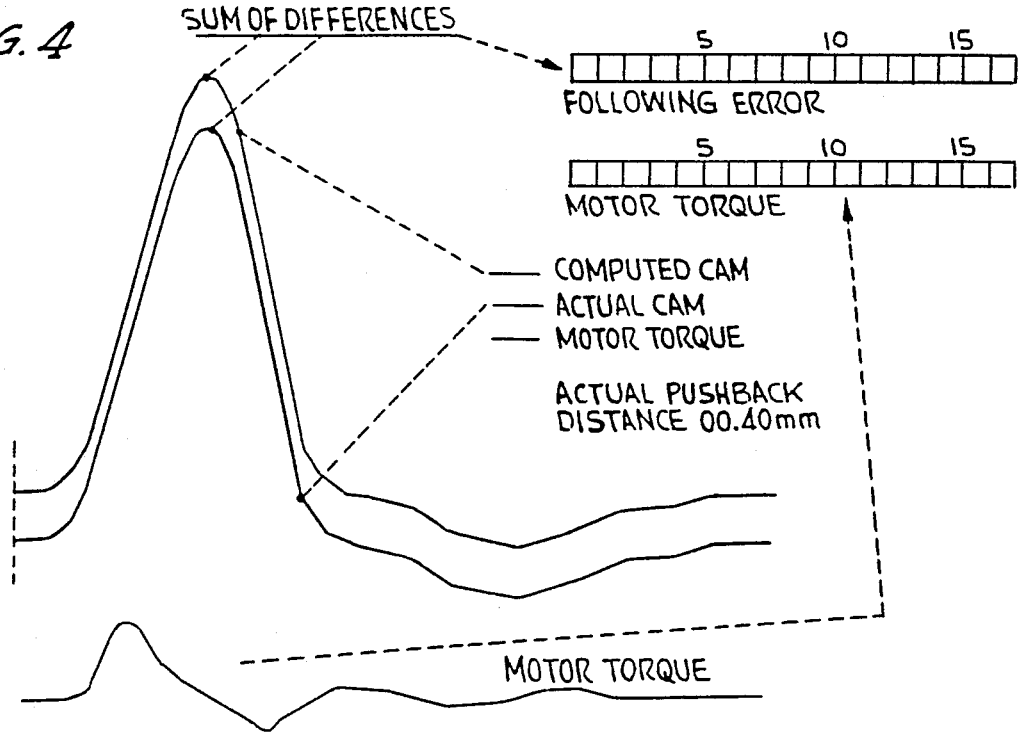
FIG. 4 is an isolated view of a display of a computed cam and actual cam of the motion control system of FIG. 2.

FIG. 4 shows a display including the commanded or computed cam curve versus actual curve or actual cam of the caster. Additionally, FIG. 4 illustrates the sum of differences between the commanded curve versus actual curve which is defined as the following error shown in bar graph form. The display also shows the actual motor torque curve and a motor torque average bar graph. Accordingly, at all times the critical features of the casting operation are displayed.

Figure 5:
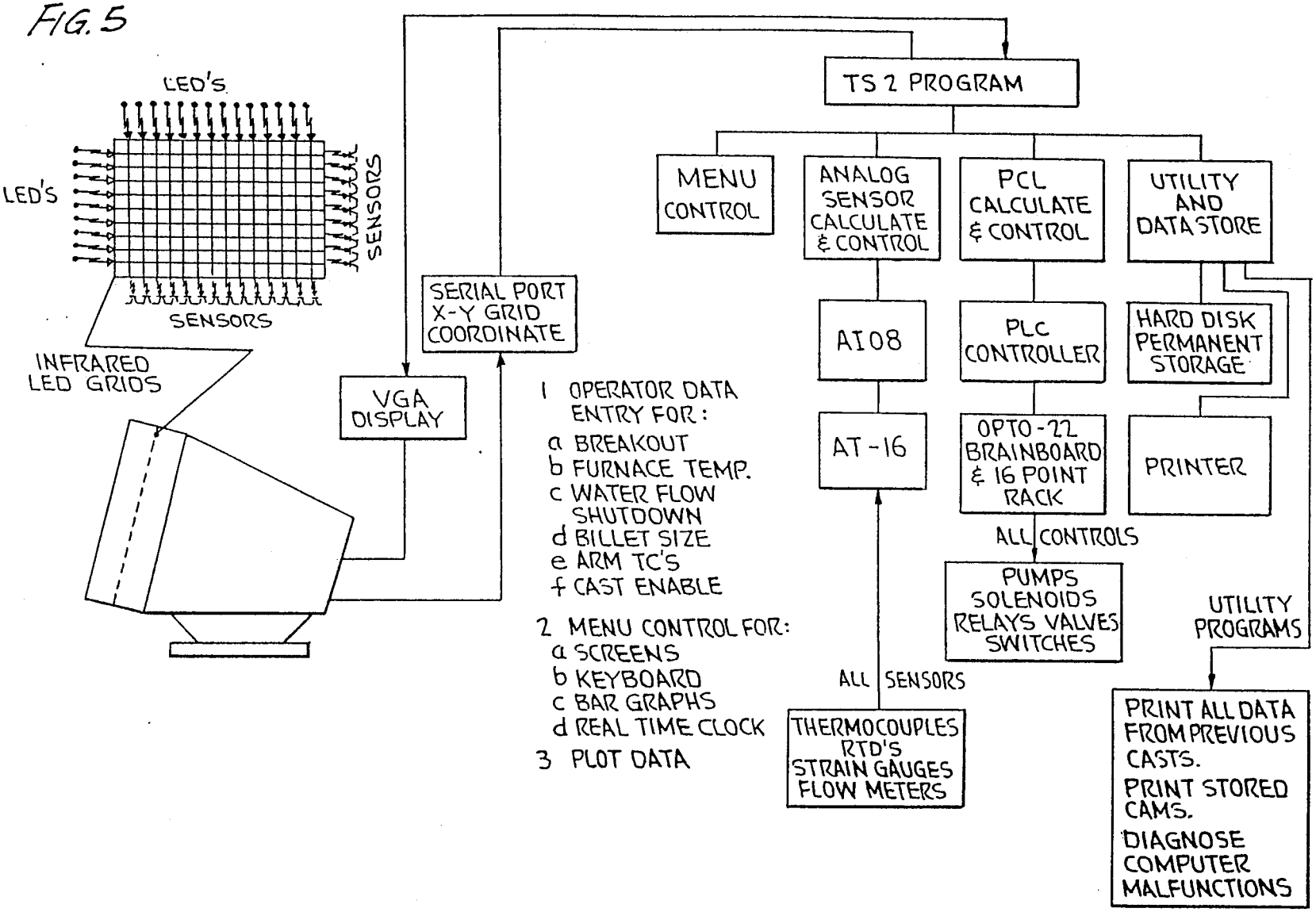
FIG. 5 is a detailed block diagram of the TS2 computer shown in FIG. 2.

FIG. 5 is a detailed illustration of the TS2 computer which provides data to the PCS program as shown in FIG. 2. As shown in FIG. 5, the computer displays simultaneously and controls parameters such as furnace temperature, water flow shutdown, billet size, and includes a menu control for the screens, keyboards, bar graphs, real-time clock, and plots data.

Figure 6:
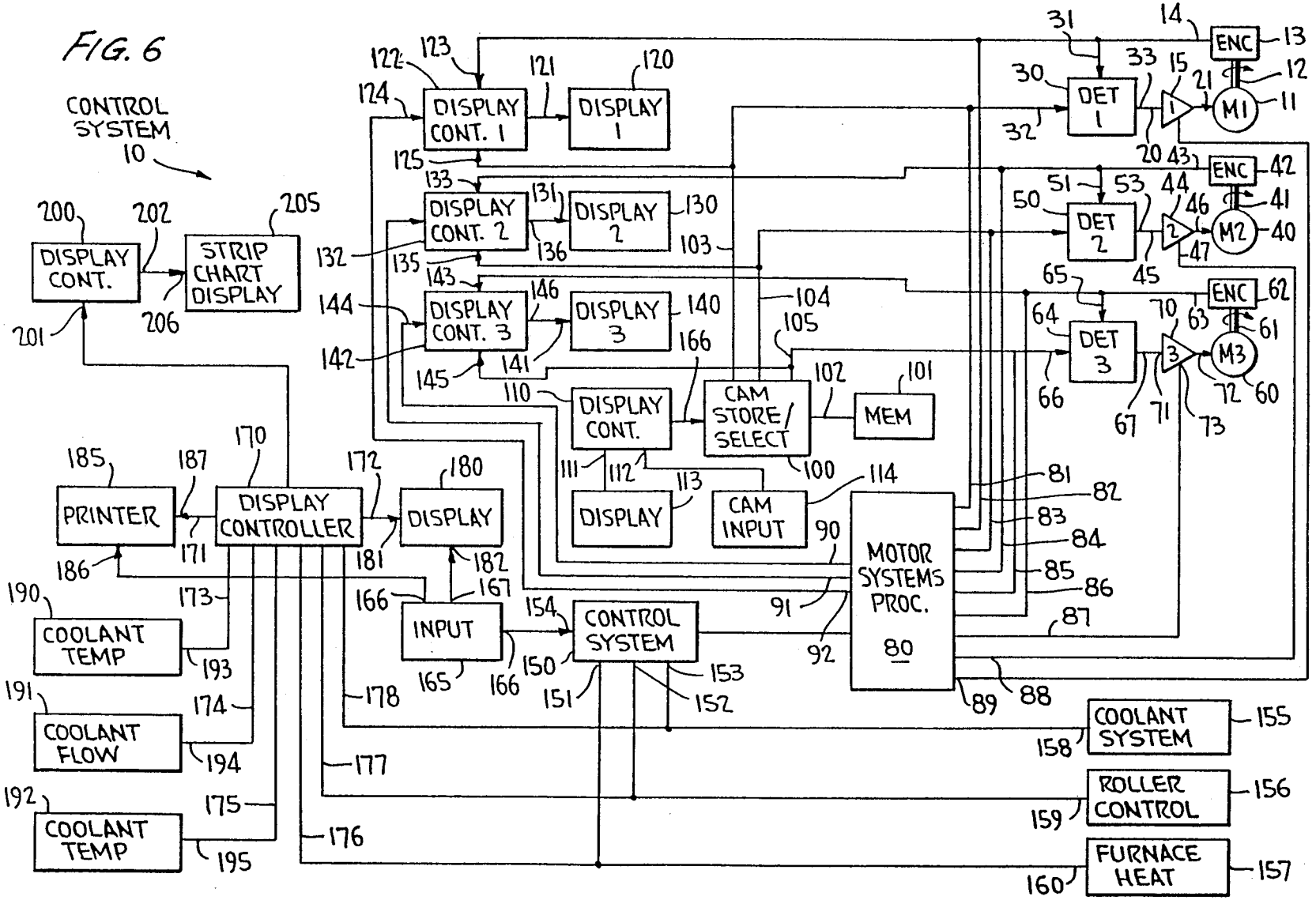
FIG. 6 is a block diagram of a motion control system of the present invention for a three-strand horizontal continuous caster.

FIG. 6 sets forth a control system 10 for a multi-strand horizontal continuous casting operation. Torque drive motor 11 includes an output shaft 12 which supports an optical encoder 13. While not shown in FIG. 6, it should be understood that output shaft 12 is coupled to appropriate drive rollers and associated mechanisms for imparting motion to a casting strand as described in reference to FIG. 1. Encoder 13 defines a conventional optical encoder having a rotary member coupled to shaft 12 and rotatable therewith. Encoder 13 further includes an output terminal 14 producing an output signal corresponding to the motion of shaft 12. A detector 30 includes a pair of input terminals 31 and 32 and an output terminal 33. Output terminal 14 of encoder 13 is coupled to input 31 of detector 30. Detector 30 provides a comparison of the input signals applied to inputs 31 and 32 thereof and produces an output signal at output 33 indicative of the relationship therebetween. A power amplifier 15 constructed in accordance with conventional fabrication techniques includes an input terminal 20 coupled to output 33 of detector 30 and an output terminal 21 coupled to motor 11. Encoder 13, detector 30, and amplifier 15 cooperate to form a proportional integral differential control loop (PID) operative upon motor 11.

A second motor 40 includes an output shaft 41 coupled to an encoder 42. Encoder 42 is constructed in accordance with conventional fabrication techniques and includes an output terminal 43. A detector 50 constructed in accordance with conventional fabrication techniques includes a pair of input terminals 51 and 52 and an output terminal 53. An amplifier 44 constructed in accordance with conventional fabrication techniques includes an input terminal 45 coupled to output terminal 53 of detector 50 and an output terminal 46 coupled to motor 40. Encoder 42, detector 50, and amplifier 44 cooperate to form a PID loop operative upon motor 40.

A motor 60 constructed in accordance with conventional fabrication techniques includes an output shaft 61 supporting an optical encoder 62. Encoder 62 includes an output terminal 63. A detector 64 includes a pair of input terminals 65 and 66 and an output terminal 67. An amplifier 70 constructed in accordance with conventional fabrication techniques includes an input terminal 71 coupled to output 67 of detector 64 and an output 72 coupled to motor 60. Encoder 62, detector 64, and amplifier 70 cooperate to form a PID loop operative upon motor 60.

A cam storage and selection processor 100 includes a trio of output terminals 103, 104 and 105 coupled to input terminals 32, 52 and 66 of detectors 30, 50 and 64, respectively. A memory 101 having stored therein a plurality of digitally encoded motion profile cams is coupled to cam processor 100 by a connection 102. A display controller constructed in accordance with conventional fabrication techniques is coupled to cam processor 100 by a connection 106. A display 113 is coupled to display controller 110 by a connection 111 and a cam input device 114 is coupled to display control 110 by a connection 112.

In response to user inputs from cam input 114, display controller 110 and cam processor 100 cooperate to provide a trio of casting profiles or cams which are applied to inputs 32, 52 and 66 of detectors 30, 50 and 64. In response to inputs at cam input 114, cam processor 100 may alternatively retrieve the desired cam profiles from memory 101 or produce a specifically structured cam profile provided by the user. In any event, display controller 110 provides a display on display 113 of the operative cams applied to detectors 30, 50 and 64.

A display controller 122 includes an input 123 coupled to output 14 of encoder 13, an input 124, an input 125 coupled to output 103 of cam processor 100, and an output 121. A display 120 is coupled to display control 122.

A display controller 132 has an input 133 coupled to output 43 of encoder 42, an input 134, an input 135 coupled to output 104 of cam processor 100, and an output 136. A display 130 has an input 131 coupled to output 136 of display controller 132.

A display controller 142 includes an input 143 coupled to output 63 of encoder 62, an input 144, an input 45 coupled to output 105 of cam processor 100, and an output 146. A display 140 includes an input 141 coupled to output 146 of display controller 142.

Display controller 122 provides an appropriate set of control signals for operation of display 120. Display 120 in turn, in its preferred form, comprises a high resolution video display such as a raster scanner CRT. Similarly, display control 132 provides appropriate display signals to display 130 while display control 142 provides appropriate control signals for display 140.

A motor systems processor 80 includes an input terminal 81 coupled to output terminal 103 of cam processor 100, an input terminal 82 coupled to output terminal 14 of encoder 13, an input terminal 83 coupled to output terminal 104 of processor 100, an input terminal 84 coupled to output terminal 43 of encoder 42, an input terminal 85 coupled to output terminal 105 of cam processor 100, and an input terminal 86 coupled to output terminal 63 of encoder 62. Motor systems processor 80 further includes input terminals 87, 88 and 89 coupled to terminals 22, 47 and 73, respectively, of amplifiers 15, 44 and 70. Motor system processor 80 further includes a trio of output terminals 90, 91 and 92 coupled to inputs 124, 134 and 144 of display controllers 122, 132 and 142, respectively.

A control system 150 which inputs information to processor 80 includes an input terminal 154 and a plurality of output terminals 151, 152 and 153. A coolant system 155 constructed in accordance with conventional fabrication techniques is operative upon the system casting molds (not shown) to provide the desired coolant transfer and flow through the casting molds. Coolant system 155 includes an input terminal 158 coupled to output 153 of control system 150. A roller control 156 is operative upon the casting system (not shown) in accordance with conventional fabrication techniques to apply a plurality of rollers to the system castings. Roller control 156 includes an input 159 coupled to output 152 of control system 150. A furnace heating system 157, constructed in accordance with conventional fabrication techniques and operative to heat the system furnace (not shown), includes an input terminal 160 coupled to output terminal 151 of control system 150. Control system 150 functions in response to input control signals applied to terminal 154 to produce the appropriate output signals communicated to coolant system 155, roller control 156 and furnace heating system 157. A display controller 170 includes a trio of input terminals 176, 177, and 178 coupled to output terminals 151, 152 and 153, respectively, of control system 150. Display controller 170 further includes a trio of input terminals 173, 174 and 175. Display controller 170 further includes an output terminal 172 and an output terminal 171. A display 180 constructed in accordance with conventional fabrication techniques includes an input terminal 181 coupled to terminal 172 of display controller 170 and an input 182. A printer 185 constructed in accordance with conventional fabrication techniques includes an input 187 coupled to output 171 of display controller 170. An input device 165 includes an output 167 coupled to input 182 of display 180, and an output 168 coupled to input 186 of printer 185. A casting temperature sensing system 190 includes a plurality of temperature sensing devices (not shown) for monitoring the temperature of various selected points within the casting system. Casting temperature sensor 190 includes an output 193 coupled to input 173 of display controller 170. A coolant flow sensor 191 includes apparatus for sensing the flow rates of coolant within coolant system 155 and includes an output 194 coupled to input 174 of display controller 170. A coolant temperature sensing system 192 includes a plurality of temperature sensors operative upon coolant system 155 for monitoring the coolant temperature therein at selected points within the system. Coolant temperature sensing system 192 includes an output 195 coupled to input 175 of display controller 170. A strip chart display 205 includes a video display and an input 206. A display control 200 includes an output 202 coupled to input 206 of display 205 and an input 201 coupled to display controller 170.

In operation, cam input 114 is used by the operator to provide the appropriate signals to display control 110 and cam processor 100 to output the desired cam profiles for operation of motors 11, 40 and 60. As mentioned, input 114 may provide signals at the operator's choice which alternatively provide profile cams which are standardized and stored within memory 101 or which are custom configured for the particular alloy or metal being cast at the time. In either event, the output signals of cam processor 100 which consists of the three desired cam profiles for motors 11, 40 and 60 are applied to detectors 30, 50 and 64, respectively. Thereafter, in accordance with the operation of the PID control loops described above operative upon motors 11, 40 and 60, the appropriate output signal is provided by detectors 30, 50 and 64 and amplified by amplifiers 15, 44 and 70, respectively, to drive motors 11, 40 and 60. Concurrently, the output of cam processor 100 is applied to display control circuits 122, 132 and 142 causing the cam profiles for motors 11, 40 and 60, respectively, to be displayed upon displays 130, 120 and 140, respectively. In addition, the output signals of encoders 13, 42 and 62 are similarly applied to display controllers 122, 132 and 142, respectively. The latter coupling permits the simultaneous display of the actual motion profile of motors 11, 40 and 60 upon displays 120, 130 and 140, respectively. Thus, during the basic system operation, displays 120, 130 and 140 are provided with information suitable for displaying both the desired cam profile and the actual resulting casting motion for each of the individual casting strands.

In addition to producing amplified drive signals for motors 11, 40 and 60, amplifiers 15, 44 and 70, respectively, each provide motor current indicative signals which are coupled to inputs 87, 88 and 89, respectively, of motor systems processor 80. In addition, the outputs of encoders 13, 42 and 62 as well as the desired cam profiles are similarly inputted to motor system processor 80. Processor 80 responds to the above-described input signals to produce performance information on each of motors 11, 40 and 60 which is coupled to display controllers 122, 132 and 142, respectively. As a result, display 120, 130 and 140 may display additional information regarding motor performance and caster operation.

Control system 150 is operative to control the functions of coolant system 155, roller control system 156, and furnace heating system 157 through conventional electromechanical control mechanisms. Control system 150 responds to the input instructions received from input device 165. Thus, the operator may select the desired operations of coolant system 155, roller control system 156, or furnace heating system 157 and implement that operation directly through control system 150. Concurrently, input 165 is operative to configure display 180 to show the operation of the casting system. In its preferred form, input 165 and display 180 may be combined in the form of a touch screen display such as the presently available infra-red detecting touch screen devices. Display controller 170 receives information regarding the performance of coolant system 155, roller control 156, and furnace heating system 157 through the operation of casting temperature sensor 190, coolant flow sensor 191, and coolant temperature sensor 192. Display controller 170 processes the input information to produce an appropriate input signal to display controller 200. Display controller 200 in turn applies the received information to strip chart display 205. Strip chart display 205 includes a conventional video display terminal such as a CRT which in accordance with an important aspect of the present invention is operative to produce a display indicative of the casting system operation on a real time basis. Thus, strip chart display 205 includes a display having a strip chart character which is operative on a real time basis indicating system performance over a predetermined interval.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

It is claimed:

1. In combination, a control system for controlling a horizontal continuous caster and a horizontal continuous caster, said caster including furnace means, mold means for molding a casting, and means for drawing a casting from said caster including an electric motor having a drive shaft; said control system comprising encoder means constructed and arranged with the shaft of said electric motor and a closed loop control system including said encoder and comprising a motion controller and an encoder/amplifier input board constructed and arranged to each receive a signal from said encoder; said motion controller constructed and arranged to provide command signals to amplifier means associated with said electric drive motor, and to provide pulses to a start-of-stroke board; said encoder and amplifier input board and start-of-stroke board feeding signals to an input/output board which, in turn, feeds a process control program; said process control program, in turn, sending signals to a display means; said system simultaneously providing a computed cam motion profile and means for controlling the operation of the caster so that the actual motion profile of the caster follows the predetermined cam profile.

2. The combination of claim 1 wherein said electric drive motor is a torque motor.

3. In a single strand or multiple strand casting system a motion control system for controlling the motion of said system including an electric drive motor comprising encoder means constructed and arranged with the shaft of an electric motor and a closed loop control system including said encoder and comprising a motion controller means and an encoder/amplifier input board constructed and arranged to each receive a signal from said encoder; said motion controller means constructed and arranged to provide command signals to amplifier means associated with said electric drive motor, and to provide pulses to a start-of-stroke board; said encoder and amplifier input board and start-of-stroke board feeding signals to an input/output board which, in turn, feeds a process control program; said process control program, in turn, sending signals to a display means; said system simultaneously providing a computed cam motion profile and means for controlling the operation of the apparatus being controlled so that the actual motion profile of the apparatus of said casting system follows the predetermined cam profile.

4. The motion control system of claim 3 wherein said electric drive motor is a torque motor.

* * * * *